US012492854B2

(12) United States Patent
Kreher et al.

(10) Patent No.: US 12,492,854 B2
(45) Date of Patent: Dec. 9, 2025

(54) METHOD FOR OPERATING AN ITEM OF LABORATORY EQUIPMENT COOLED BY MEANS OF A FLAMMABLE REFRIGERANT

(71) Applicant: Eppendorf SE, Hamburg (DE)

(72) Inventors: René Kreher, Leipzig (DE); Falk Binder, Hamburg (DE); Thomas Sporn, Hamburg (DE)

(73) Assignee: Eppendorf SE, Hamburg (DE)

( * ) Notice: Subject to any disclaimer, the term of this patent is extended or adjusted under 35 U.S.C. 154(b) by 237 days.

(21) Appl. No.: 18/074,666

(22) Filed: Dec. 5, 2022

(65) Prior Publication Data

US 2023/0175755 A1 Jun. 8, 2023

(30) Foreign Application Priority Data

Dec. 8, 2021 (EP) ..... 21213227

(51) Int. Cl.
*F25D 17/06* (2006.01)

(52) U.S. Cl.
CPC ..... *F25D 17/06* (2013.01)

(58) Field of Classification Search
CPC ..... F25D 17/06
See application file for complete search history.

(56) References Cited

U.S. PATENT DOCUMENTS

| | | | | |
|---|---|---|---|---|
| 5,261,252 | A | 11/1993 | Peruch | |
| 11,125,457 | B1 * | 9/2021 | Alfano | F24F 11/56 |
| 2019/0383509 | A1 * | 12/2019 | Takagi | F25B 49/02 |
| 2021/0252526 | A1 * | 8/2021 | Müller | B04B 15/02 |

FOREIGN PATENT DOCUMENTS

| | | | |
|---|---|---|---|
| CN | 202565643 | | 11/2012 |
| DE | 102012103211 | A1 | 10/2012 |
| JP | H11159924 | A * | 6/1999 |
| JP | 2005306203 | A | 11/2005 |
| JP | 2011106697 | A * | 6/2011 |
| JP | 2021527559 | A | 10/2021 |
| WO | 2019238891 | A1 | 12/2019 |

OTHER PUBLICATIONS

Translated_Kanji (Year: 1999).*
Translated_Morishita (Year: 2011).*

* cited by examiner

*Primary Examiner* — Jerry-Daryl Fletcher
*Assistant Examiner* — Samba Gaye
(74) *Attorney, Agent, or Firm* — Downs Rachlin Martin PLLC

(57) ABSTRACT

A method of operating an item of laboratory equipment cooled using a flammable refrigerant. The method includes ventilating an interior of the cooled laboratory equipment with the aid of a fan, wherein control of the fan is carried out over a first time period by a first control device; checking, with the aid of a first predefined criterion, whether the ventilation was successful; transferring control of the fan to a second control device if ventilation was successful over the first time period; checking, with the aid of a second predefined criterion, whether the fan is being successfully controlled by the second control device; activating a power supply for at least one further device, which is to be electrically powered, of the cooled laboratory equipment if the fan is being successfully controlled by the second control device. A corresponding item of laboratory equipment is also disclosed.

11 Claims, 3 Drawing Sheets

METHOD FOR OPERATING AN ITEM OF LABORATORY EQUIPMENT COOLED BY MEANS OF A FLAMMABLE REFRIGERANT

RELATED APPLICATION DATA

This application claims the benefit of priority of European Patent Application No. 21213227.8, filed Dec. 8, 2021, and titled "Method for Operating an Item of Laboratory Equipment Cooled by Means of a Flammable Refrigerant", which is incorporated by reference herein in its entirety.

FIELD OF THE DISCLOSURE

The invention relates to a method for operating an item of laboratory equipment cooled by means of a flammable refrigerant as well as to an item of laboratory equipment that is cooled by means of a flammable refrigerant. In particular, the item may be a laboratory device or a laboratory apparatus.

BACKGROUND

Cooled items of laboratory equipment must satisfy various safety requirements. The standard DIN EN 61010-2-011, for example, specifies safety requirements for electrical measuring, control, and laboratory equipment. In particular, the intention is to ensure that the configuration and the construction of refrigeration equipment provides adequate protection against certain hazards for users, bystanders, trained service personnel and the surrounding areas, moreover against the specific hazards that may originate from cooled systems.

In the standard DIN EN 378, the life cycle of refrigerating systems is considered, especially with regard to system/appliance safety, but also, for example, with regard to installation areas of the systems, limit values of refrigerants or the protection of persons in cold rooms. The standard deals in particular with the flammability classes 1 (no flame spread), 2L (mildly flammable), 2 (flammable) and 3 (highly flammable) for refrigerants, which are defined in the ISO 817 standard. Examples of refrigerants are, for example: propane, (iso)butane (flammability class 3); R152a (flammability class 2); R1234yf (flammability class 2L); R410A, R22 (flammability class 1).

Highly flammable hydrocarbons in particular, however, especially propane and (iso)butane, have favorable environmental properties. For example, the ozone depletion potential ("ODP") value for each of the refrigerants mentioned is zero, and the global warming potential ("GWP") or CO2 equivalent is only three.

It is desirable to use refrigerants having favorable environmental properties in today's cooled laboratory equipment. With regard to the mentioned refrigerants propane and (iso)butane, extended safety precautions are necessary. In particular, a safe environment within the machine is necessary. The environment must remain safe, in particular even if a flammable refrigerant escapes, for example in the event of leakage, damage or malfunction.

SUMMARY OF THE DISCLOSURE

In one implementation, the present disclosure is directed to a method for operating an item of laboratory equipment cooled by means of a flammable refrigerant, the method comprising the steps of ventilating an interior of the cooled item of laboratory equipment with the aid of a fan, wherein control of the fan is carried out over a first time period by a first control device; checking, with the aid of a first predefined criterion, whether the ventilation was successful; transferring control of the fan to a second control device if ventilation was successful over the first time period; checking, with the aid of a second predefined criterion, whether the fan is being successfully controlled by the second control device; activating a power supply for at least one further device, which is to be electrically powered, of the cooled item of laboratory equipment if the fan is being successfully controlled by the second control device.

In another implementation, the present disclosure is directed to an item of laboratory equipment cooled by means of a flammable refrigerant and comprising a fan configured to ventilate an interior of the cooled item of laboratory equipment; first control device configured to control the fan in such a way that ventilation of the interior is carried out over a first time period; a checking device configured to check, using a first predefined criterion, whether ventilation was successful over the first time period; a second control device configured to control the fan; a transfer device configured to transfer control of the fan to the second control device if ventilation was successful over the first time period; an activation device configured to activate a power supply for at least one further device, which is to be electrically powered, of the cooled item of laboratory equipment if the fan is being successfully controlled by the second control device; wherein the checking device is additionally configured to check, with the aid of a second predefined criterion, whether the fan is successfully controlled by the second control device, or the cooled item of laboratory equipment comprises a further checking device configured to check, with the aid of a second predefined criterion, whether the fan is being successfully controlled by the second control device.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

Figure 1:
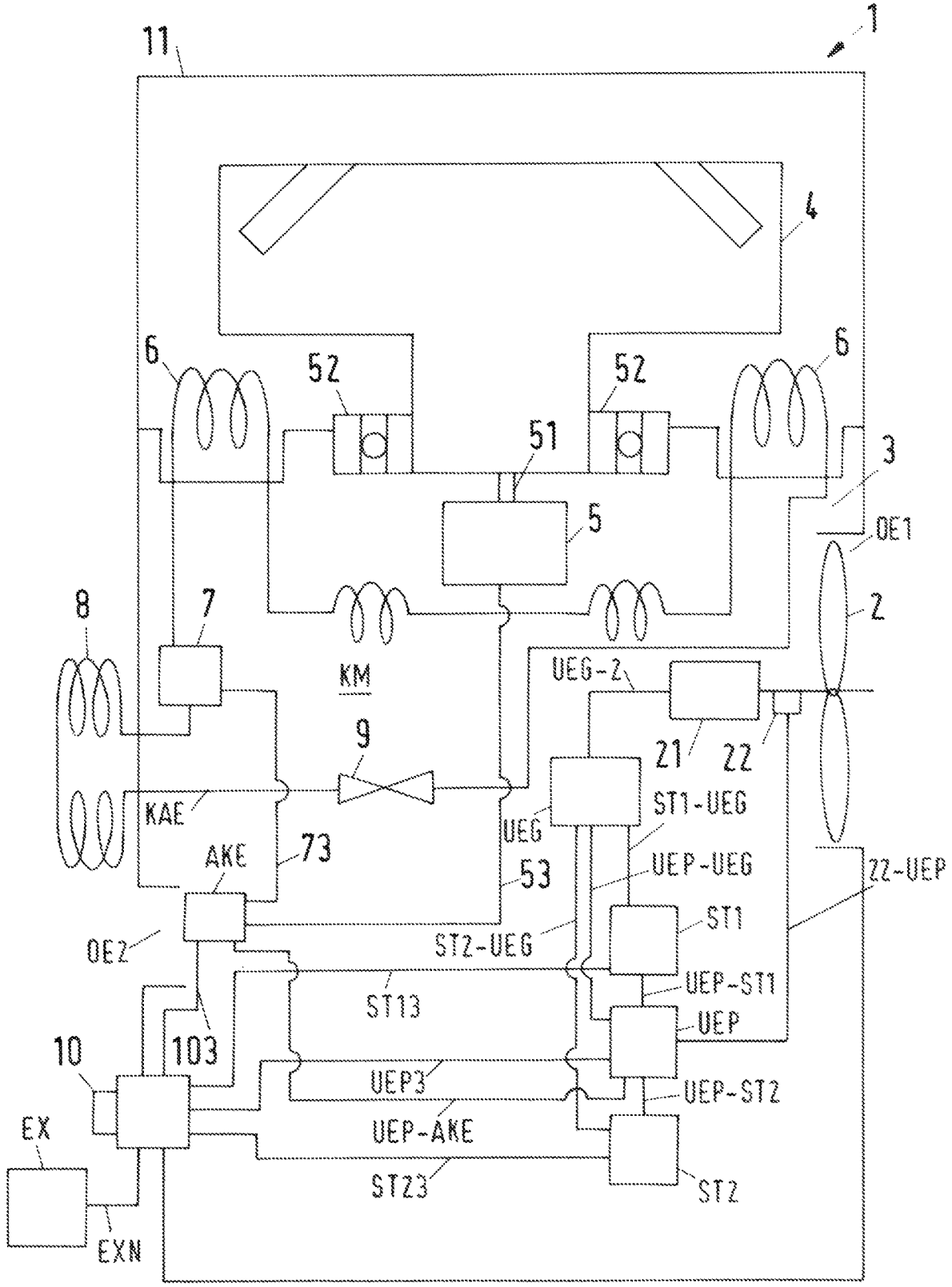
FIG. 1 shows a schematically illustrated embodiment of a cooled item of laboratory equipment according to the invention.

The present invention is based on the technical problem of improving the operational safety of cooled laboratory equipment cooled by means of a flammable refrigerant. Another technical problem forming the basis of the present invention is to realize a particularly fail-safe and reliable fan control and to detect defects of a fan particularly early and reliably.

In accordance with a basic concept of the present invention, it is proposed to first ventilate an interior of a cooled item of laboratory equipment (in short "cooled laboratory equipment") with a fan after switching on, controlled with the aid of a first control device, which may in particular be a hardware-based control device. Such a ventilation process may in particular have a defined minimum duration. A first test operation (by means of which, for example, the proper functioning of the fan may be checked) and/or a first safety operation (by means of which, for example, refrigerant may be removed from the interior by the fan) of the fan may be carried out in this way. The first control device and/or the fan may have a power supply that may be independent of other power supplies of further components or devices of the cooled laboratory equipment and/or may be activatable independently of the other power supplies and/or may be formed separately. In particular, the power supply may, for example, have a separate cable harness.

The first control device may in particular have a particularly simple structure. "Hardware-based" may in particular mean that all control commands are pre-specified, defined and/or implemented on the hardware side in the first control device—for example by using electrical or electronic components. "Hardware-based" may alternatively or additionally mean in particular that a function of the first control device may be achieved by a discretely constructed circuit and/or that a function of the first control device may be achieved by a use of standard components (in particular, these may be standard electrical or electronic components). In particular, the first control device may be a control device without a data interface and/or without a data memory. The first control device may also comprise, for example, only a ROM memory. "Hardware-based" may alternatively or additionally mean, with respect to the first control device, that the first control device has no software or no firmware. "Hardware-based" may alternatively or additionally mean, with respect to the first control device, that the first control device does not have a chip or memory on which software or firmware is stored. "Hardware-based" may alternatively or additionally mean, with respect to the first control device, that the first control device does not have control algorithms or control commands stored on a chip or in a memory.

The first control device may in particular have an on/off switch or, in a particularly simple embodiment, may consist of an on/off switch that may be coupled with an on/off switch of the laboratory equipment. If, for example, the on/off switch of the laboratory equipment is switched on, the first control device may also be switched on automatically in such a way that the fan ventilates the interior.

Ventilation may serve as a test run of the fan and may also remove refrigerant from the interior. Other (or all other) devices of the laboratory equipment which are to be electrically powered may at least remain switched off until it has been automatically determined that ventilation was successful and/or until control of the fan has been transferred to a second control device and it has been automatically determined that control of the fan by the second control device has been successful.

In particular, this may avoid a risk of sparks forming in the interior of the cooled laboratory equipment, said sparks possibly causing the refrigerant to ignite if the flammable refrigerant is present in the interior.

The second control device may in particular be a control device that is a software- and/or firmware-based control device. It may, for example, have a memory (for example a rewritable memory chip or a hard disk), for example with stored program commands and/or a measurement sensor system (for example a temperature sensor or a measurement probe for a concentration of the refrigerant) and/or may allow variable-speed control of the fan, for example by means of pulse width modulation, with the aid of corresponding devices, for example with the aid of stored characteristic curves, which may, for example, link values of the temperature sensor or the measurement probe with speeds. If the second control device is firmware-based, program commands may be stored in particular on a ROM memory. If the second control device is software-based, program commands may be stored in particular on a read-write memory. The second control device may be configured to control the fan even during normal operation of the cooled laboratory equipment. Normal operation of the cooled laboratory equipment may follow the method according to the invention.

"Software-based" may alternatively or additionally mean, with respect to the second control device, that the second control device has software. "Software-based" may alternatively or additionally mean, with respect to the second control device, that the second control device has a chip or a memory on which software is stored. "Software-based" may alternatively or additionally mean, with respect to the second control device, that the second control device comprises control algorithms or control commands stored on a chip or in a memory (in particular on a read-write memory).

"Firmware-based" may alternatively or additionally mean, with respect to the second control device, that the second control device has firmware. "Firmware-based" may alternatively or additionally mean, with respect to the second control device, that the second control device has a chip or a memory on which firmware is stored. "Firmware-based" may alternatively or additionally mean, with respect to the second control device, that the second control device comprises control algorithms or control commands stored on a chip or in a memory (in particular on a read-only memory).

The second control device may be a control device for which the safety and/or reliability and/or correct functioning must first be proven through an approval procedure or certification procedure. Such a procedure may be very time-consuming and cost-intensive. In addition, even small subsequent changes may therefore involve a great deal of effort. For example, even small subsequent changes may each require a separate approval procedure or certification procedure.

The second control device may be generally connected to an equipment-side control device that controls the cooled laboratory equipment (and in particular a fan of the cooled laboratory equipment) in operation. The second control device may be this equipment-side control device or a part of this equipment-side control device or may be connected to it or integrated into it. However, it is not excluded that the second control device may be a separate control device from the equipment-side control device.

In particular, what is proposed is a method for operating an item of laboratory equipment cooled by means of a flammable refrigerant, the method comprising the steps of ventilating an interior of the cooled item of laboratory equipment with the aid of a fan, wherein control of the fan is carried out over a first time period by a first control device; checking, with the aid of a first predefined criterion, whether the ventilation was successful; transferring control of the fan to a second control device if ventilation was successful over the first time period; checking, with the aid of a second predefined criterion, whether the fan is being successfully controlled by the second control device; activating a power supply for at least one further device, which is to be electrically powered, of the cooled item of laboratory equipment if the fan is being successfully controlled by the second control device.

The flammable refrigerant may in particular be a refrigerant of flammability class 2L, 2 or 3. The flammable refrigerant may be, for example, propane or butane or isobutane (flammability class 3). Other refrigerants, including refrigerants of flammability classes 2L and 2, are not excluded.

The cooled laboratory equipment may be an item of equipment that has a cooling function in operation, for example for samples. The cooled laboratory equipment may in particular have a refrigeration circuit in which the refrigerant is used. The refrigeration circuit may in particular comprise an evaporator, a compressor, a liquefier (for example a condenser) and/or a throttling element. Furthermore, the refrigeration circuit may in particular comprise connection elements, seals and/or conduits. The further device to be electrically powered may for example be a component of the refrigeration circuit, for example the compressor, which may be embodied as an electrically operated compressor, or for example a motor (for example of a centrifuge rotor). In particular, the cooled laboratory equipment may be, for example, a laboratory centrifuge or a laboratory freezer. Other equipment and equipment types are not excluded.

Ventilation of the interior may in particular be an aeration of the interior, in particular so that any flammable refrigerant that may be present is completely or largely removed from the interior. Flammable refrigerant could be present in the interior in situations in which, for example, a leak of the refrigeration circuit or of a component of the refrigeration circuit occurs and as a result the flammable refrigerant has partially entered the interior.

The interior may be, for example, an interior of a housing or of a housing part or an interior under, at, near or inside a cover or an inner wall or an outer wall of the cooled laboratory equipment. The interior may, for example, contain at least one component or all components of the refrigeration circuit and/or may be adjacent to at least one component or all components of the refrigeration circuit and/or may be located close to at least one component of the refrigeration circuit. The interior may also contain further components of the cooled laboratory equipment, for example electronics or a motor. The interior may for example have at least one opening to the outside, preferably several openings, to ensure air exchange with a space outside the interior, in particular an outside space and/or an environment.

The fan may in particular be a ventilator or may comprise a ventilator. The fan may, for example, be an axial fan or an axial blower or may comprise an axial fan or an axial blower. The fan may in particular be controllable in its speed, so that different fan speeds are possible, for example by means of pulse width modulation (the term pulse width modulation may be understood as a synonym for the term pulse duration modulation). The fan may be located, for example, at the opening to the outside. The fan may preferably be integrated in particular in the cooled laboratory equipment. It is not excluded that the fan is embodied as an external unit.

Controlling the fan over the first time period may mean in a simple embodiment that the fan is switched on and remains switched on over the first time period. For example, the fan may be controlled in such a way that it should reach and/or not fall below a first predefined fan speed over the first time period. The fan may have a speed determination device (for example a Hall sensor) for determining a tachometer signal and/or a number of revolutions per unit of time or may be connected to such a speed determination device.

The first time period may be a predefined time period, for example 3-20 seconds, preferably 5-15 seconds, particularly preferably 8-10 seconds. In particular, the first time period may be dependent on an interior volume and a volume flow of a fan used. A counting or measurement of the first time period may be performed automatically by means of a timing device containing a timer. The counting or measurement of the first time period may alternatively or additionally be realized with the help of an analogue or digital timer. In a simple embodiment, a counting or measurement of the first time period may start as soon as the fan is switched on or running. Alternatively or additionally, a counting or measurement—in particular the start of a counting or measurement—may be linked to a condition. For example, the first time period or a time measurement may start as soon as the fan is switched on and has reached a specific fan speed.

The first control device may, for example, have an on/off switch. The on/off switch may be actuated, for example, when the laboratory equipment is switched on. The on/off switch may be coupled to an on/off switch of the laboratory equipment or may be the on/off switch of the laboratory equipment. Performing the ventilation may be part of the switching-on process of the laboratory equipment. In particular, the ventilation may be performed before the further device, which is to be electrically powered, of the cooled laboratory equipment (or several or all further devices, which are to be electrically powered, of the cooled laboratory equipment) are switched on or powered. Ventilation may be carried out, in particular, automatically. In particular, this may mean that the intervention of a human user is not required to perform the ventilation. A human user may initiate a switch-on process of the cooled laboratory equipment if desired, for example by actuating the on/off switch of the laboratory equipment.

The first control device may in particular have a particularly simple structure. In particular, it may be hardware-based. In this regard, reference is made to the explanations above. The first control device may in particular have a simple control logic implemented in hardware, which allows operation of the fan at a specific fan speed, which may be a maximum speed of the fan or a specific fan speed. More complex embodiments of the first control device are not excluded. The first control device and/or the fan may have a power supply device/power supply devices (for example, this may be a cable, a connector, and/or a mains adapter) which is/are separate and/or independent and/or spatially separated from further power supply devices of further devices of the cooled laboratory equipment. The power supply device(s) may, for example, have a separate line/separate lines and/or a separate external connection/separate external connections on the cooled laboratory equipment or a separate cable harness or connection/separate cable harnesses or connections within the cooled laboratory equipment. The power supply device(s) may be connectable independently of the further power supply devices.

If only the first control device and/or the fan is/are initially switched on during a switch-on process of the cooled laboratory equipment during the process of ventilation and further devices of the cooled laboratory equipment are not (yet) supplied with electric current, the risk of sparking, in particular in the interior of the cooled laboratory equipment, is reduced. Flammable refrigerant, if present, may thus first be removed by the process of ventilation. Further devices where sparks could possibly occur during a power supply are only switched on later when there is no longer flammable refrigerant present.

The first predefined criterion may be checked in particular with the aid of a checking device. In a simple embodiment, the checking device may, for example, have a threshold switch. Such a threshold switch may comprise an electrical capacitor that is charged as soon as a specific fan speed is reached and/or an alternative timer or time counter. As soon as, for example after the first time period, a specific charge value of the electrical capacitor is reached and thus a specific voltage value at the electrical capacitor, the presence of the voltage value may be used as a signal that the checking with the aid of the first predefined criterion is successful. If, on the other hand, the fan speed falls below a specific value, the electrical capacitor may be discharged again. Only when the specific fan speed is reached over a specific time period (for example, the first time period) may the voltage value be high enough for the first predefined criterion to be considered successfully fulfilled. In a more complex embodiment, the checking device may alternatively or additionally comprise a checking logic, for example realized by means of a computing device (for example a processor) and corresponding commands, control rules and/or characteristic curves. The checking device may also have a timer.

The checking device may alternatively or additionally have, for example, an AC voltage amplifier that loads energy into the electrical capacitor during edge changes of a tachometer signal (corresponding to a fan speed signal). If a frequency of the edge changes (and thus the fan speed) is sufficiently high (i.e. for example equal to or above the specific fan speed), a higher electrical power enters the electrical capacitor than is extracted from it. The checking device may further alternatively or additionally comprise, for example, an integrated circuit such as a retriggerable, monostable multivibrator or a monoflop.

The checking device may further alternatively or additionally have, for example, a counter that defines a minimum time for ventilation (which may be the first time period) in the form of a defined cycle duration. If the fan speed falls below the specific value, the counter may be reset so that a counting process of the counter has to start again.

As already mentioned, the fan may have a speed measuring device for measuring a tachometer signal and/or a number of revolutions per unit of time or may connected to such a speed measuring device. Embodiments for speed measuring devices are known in the prior art, for example speed measurement by means of a Hall sensor is possible. The checking device may be part of the first control device or may be connected thereto. A power supply of the checking device may be connected to a power supply of the first control device. The power supply of the checking device may be carried out with the aid of a power supply device which is separate and/or independent and/or spatially separated from further power supply devices of further devices of the cooled laboratory equipment.

The first predefined criterion may, for example, have a condition relating to a fan speed and/or relating to a time period during which the fan is to operate, for example, at a specific fan speed. The first predefined criterion may—more specifically—for example be that a specific fan speed, which may also for example be referred to as the first predefined fan speed, must be reached and/or not dropped below. Reaching and/or not falling below the first predefined fan speed may be required by the first predefined criterion over a specific time period, which may be the first time period. The condition that a specific fan speed (which may be the first predefined fan speed) must be reached over a specific time period (which may be the first time period) may be such that, at the specific fan speed and with the specific time period, experience has shown that it is ensured that flammable refrigerant present in the interior is completely or almost completely removed from the interior. Ventilation may be considered successful in particular if the first predefined criterion has been fulfilled.

As already mentioned, the second control device may in particular be a control device that is a software- and/or firmware-based control device. Reference is made to the above comments regarding the second control device. For example, the second control device may be configured to realize a demand-based control of the fan. For example, the second control device may have a measurement sensor system (for example a temperature sensor for determining a temperature value in the interior and/or in an outside area or a measurement probe for a concentration of the refrigerant), with the aid of which a ventilation requirement—for example by means of integrated rules and/or characteristic curves defined on the software/firmware side—and a corresponding fan speed may be determined.

Transferring control of the fan may be, for example, transferring monitoring or control via a power supply of the fan, for example by means of a transfer device, which may be, for example, a corresponding switch (for example an RS flip-flop) or may comprise a corresponding switch (for example an RS flip-flop) which triggers a corresponding switching operation. For example, the switch may be triggered when a signal or voltage value is output or present at the electrical capacitor, indicating that ventilation has been successful. The transfer device may also comprise an electronic controller and/or a computing device (for example a processor) and/or a relay.

In particular, the transfer may be carried out if the first predefined criterion has been successfully fulfilled. If the first predefined criterion has not been successfully fulfilled or the ventilation has not been successful, the consequence may in particular be that the transfer is not carried out. In this case, for example, operation of the cooled laboratory equipment may be terminated or prevented, for example, on the basis of a predefined switch-off criterion, for example if, after a predefined time period, it has not been achieved that the first predefined criterion has been fulfilled. If ventilation was not successful, the cooled laboratory equipment may be switched off automatically or not switched on at all.

The second control device may generally be more complex in design than the first control device, in particular if it is software- and/or firmware-based. The first control device, since it is particularly simple in design, may be particularly reliable or fail-safe, particularly more reliable or fail-safe or less error-prone than the second control device. The first control device is therefore well suited to initially ventilate the interior in order to remove any flammable refrigerant that may be present from the interior in a particularly reliable manner. Additionally, it is advantageous that a risk of sparking is reduced, as explained above.

Whether the second predefined criterion has been fulfilled may be checked in particular with the aid of a further checking device, for example comprising a computing device (for example a processor) and commands, control rules and/or characteristic curves for checking the tachometer signal of the fan and/or a timer. Alternatively or additionally, it is not excluded that the checking device with the aid of which the first predefined criterion is checked additionally checks whether the second predefined criterion has been fulfilled.

The further checking device may be part of the second control device or may be connected thereto. A power supply of the further checking device may be connected to a power supply of the second control device. The power supply of the further checking device may be carried out with the aid of a power supply device which is separate and/or independent and/or spatially separated from further power supply devices of further devices of the cooled laboratory equipment.

The second predefined criterion may, for example, have a condition relating to a fan speed and/or relating to a time period during which the fan is to operate, for example, at a specific fan speed. The second predefined criterion may—more specifically—for example be that a specific fan speed, which may also for example be referred to as the second predefined fan speed, must be reached and/or not dropped below. Reaching and/or not falling below the second predefined fan speed may be required by the second predefined criterion over a specific time period.

The activation of the power supply for the at least one further device which is to be electrically powered may, for example, be carried out with the aid of an activation device, for example comprising a computing device (for example a processor) and corresponding commands. Activation may take place after a specific delay time, which for safety reasons must have elapsed since the transfer. The delay time may be, for example, 5 seconds or 10 seconds. The delay time may also be shorter, for example 5-1 seconds. The activation device may alternatively or additionally in particular comprise a switch, for example a relay, for activating a power supply for the at least one further device which is to be electrically powered, or may be connected to such a switch. The activation may in particular be performed if the second predefined criterion has been successfully fulfilled. The term "further device to be electrically powered" is to be understood in such a way that the fan itself is not included by this term.

The at least one further device to be electrically powered may be any further component of the cooled laboratory equipment that is to be electrically powered. In particular, it may be a component of the refrigeration circuit, for example the compressor, a drive motor (for example if the cooled laboratory equipment is a centrifuge), a display or a control unit. Activating the power supply for the at least one further device to be electrically powered may also mean that the cooled laboratory equipment is switched on—for example completely—so that an operation of the cooled laboratory equipment (for example, if it is a centrifuge, an operation) may begin.

The method may be such that the activation of the power supply for the at least one component is not performed or, for example, is not performed within a predefined time period or is not performed before the cooled laboratory equipment is switched off and switched on again if the control by the second control device or the second control method is not successful.

All of the above steps of the method may be performed or executed automatically. The step of ventilating the interior may be followed by the step of checking with the aid of the first predefined criterion. The step of checking using the first predefined criterion may be followed by the step of transferring control. The transfer step may be followed by checking with the aid of the second predefined criterion. The step of checking with the aid of the second predefined criterion may be followed by the step of activation. The method may be such that the next step only follows when the previous step has been completed.

The presented method offers a simple and economical possibility for improving the operational safety of cooled laboratory equipment which is cooled by means of a flammable refrigerant. Before there is a risk of sparking in relation to the flammable refrigerant, any flammable refrigerant that may be present is removed from the interior by ventilating the latter. Furthermore, a test run of the fan is carried out in order to detect a malfunction of the fan at an early stage. In addition to the fact of ventilating as such and the increased operational safety already resulting from this, it is also advantageous that a particularly fail-safe and independent hardware-based control (if the first control device is configured in such a way) controls the ventilation, and a defect of the fan (for example a mechanical blockage or a contact problem) may be detected early and reliably, in particular already before spark sources are activated inside the cooled laboratory equipment.

It is also advantageous that a problem of the second control device may be identified separately, wherein the second control device may realize a demand-oriented fan speed, in particular by means of pulse width modulation, provided it is configured accordingly. The second control device may be activated in an advantageous manner only when a defect in the fan may be ruled out. Since the first control device is fundamentally more reliable than the second control device, a potentially harmful fan malfunction directly after the cooled laboratory equipment is switched on is additionally particularly effectively prevented—by the initial use of the first control device.

It is also advantageous that an initial ventilation control, which may be hardware-based in particular, requires little effort in respect of development and approval. Other, constructively more complex and/or more expensive control or protection measures (for example pressure sensors) become superfluous.

The present invention is suitable in principle for all equipment containing a refrigeration circuit with flammable refrigerant. The present invention may also be applied to other appliances that contain or that produce hazardous gases or other vapors that are hazardous to health.

In an advantageous embodiment of the method according to the invention, a power supply for the fan is established before the interior is ventilated, in particular immediately before ventilation.

The power supply may preferably be established in particular with the aid of an on/off switch of the cooled laboratory equipment. The cooled laboratory equipment may be configured so that the on/off switch is the only switch that needs to be operated at the start of operation of the cooled laboratory equipment. Ventilation of the interior may then be started automatically. The power supply may also, less preferably, be provided with the aid of a separate on/off switch.

"Immediately prior to ventilation" may mean that ventilation immediately follows a power-up—for example using the on/off switch of the cooled laboratory equipment—for example preferably within 5 seconds, or within 10 seconds, or 20 seconds, or one minute.

The presented embodiment allows a simple and user-friendly switch-on process. In particular, if the power supply is established immediately before ventilation, the switch-on process may be particularly safe, as it were, since a time period during which the fan is electrically powered before the interior is ventilated is very short and thus the risk of sparking at the fan itself is minimized.

In an advantageous embodiment of the method according to the invention, the power supply for the fan is established by a switch-on process of the cooled laboratory equipment. In particular, this may mean that the power supply for the fan is automatically established when the cooled laboratory equipment is switched on, for example with the aid of an on/off switch of the cooled laboratory equipment. The switch-on process may comprise further steps after the power supply for the fan has been established. Further steps of the switch-on process—in particular the transfer of control of the fan and the activation of the power supply for at least one further device, which is to be electrically powered, of the cooled laboratory equipment—may follow thereafter.

The presented embodiment allows a particularly simple and user-friendly switch-on process.

In an advantageous embodiment of the method according to the invention, the first control device is a hardware-based control device.

Reference is made to the above remarks regarding the hardware-based control device and the term "hardware-based". The hardware-based control device may have a particularly simple design and may be independent of further devices of the cooled laboratory equipment and therefore may be particularly reliable and fail-safe. A defect of the fan, for example a blockage or a contact problem, may be detected before further devices of the cooled laboratory equipment are able to be damaged. If the fan is defective, operation of the cooled laboratory equipment may still be impossible anyway. A determination of such a defect may advantageously be made before there is a danger of ignition of the refrigerant by further, potentially spark-forming devices of the cooled laboratory equipment, the switch-on of which in the case of a defective fan would in any case be pointless and possibly harmful.

In an advantageous embodiment of the method according to the invention, the second control device is a software-based or a firmware-based control device.

Reference is made to the above comments regarding the software-based or firmware-based control device and to the terms "software-based" and "firmware-based". The software-based or firmware-based control device is advantageous because it may, in particular, allow demand-oriented control of the fan, in particular demand-oriented control of the fan speed. If the ventilation requirement is low, for example due to an already low temperature in the interior, a low fan speed may be sufficient. Only when there is a high ventilation requirement, for example when the temperature in the interior is increased, may a high fan speed need to be set. This may be implemented, for example, with the help of characteristic curves or characteristic maps. This embodiment allows for low energy consumption by the fan, low wear and tear and a long service life of the fan, lower maintenance requirement, low contamination, for example by dust in the interior, as well as lower noise development.

In an advantageous embodiment of the method according to the invention, the first criterion is or comprises not falling below or reaching a first predefined fan speed.

The expression "not falling below" may in particular mean not falling below a certain level over a specific time period. The specific time period may be, for example, the first time period. The specific time period may be a time period which, in conjunction with the first predefined fan speed, allows the ventilation in such a way that flammable refrigerant is completely or approximately completely removed from the interior. The first predefined fan speed may be selected accordingly so that it allows ventilation in such a way that flammable refrigerant is completely or approximately completely removed from the interior within the specific time period.

How long the specific time period must be and what fan speed must be required for this may be determined, for example, on a trial basis and/or with the help of simulations. The first predefined fan speed may alternatively be a (for example predefined) maximum speed at a specific voltage (for example 12 V) or a nominal speed of the fan.

Reaching a first predefined fan speed is also conceivable as a first criterion. For example, it may be required that a certain level is reached within a specific time period. For example, it may be measured whether the first predefined fan speed is properly reached and/or whether it is reached within a time period. The time period may be, for example, a typical acceleration time of the fan, for example in the interval of 0.1 to 3 seconds. If the acceleration is too slow, i.e. the first predefined fan speed is not reached within the time period, this may indicate a defect in the fan.

The first predefined fan speed may itself be a variable value. For example, the first predefined fan speed may depend on a temperature, for example an interior temperature or an outside temperature, or on a time period in which the cooled laboratory equipment was not in operation.

The presented embodiment makes it possible to reliably assess the functionality of the fan in a simple and easy-to-implement manner with little effort in terms of control and testing. In particular, it may be tested in a simple way whether the fan itself is functioning properly. If, for example, proper control by the second control device fails, it may be ruled out already that there is a fault in the fan itself (for example blockage, mechanical defect, contact problems, etc.).

In an advantageous embodiment of the method according to the invention, the second criterion is or comprises not falling below a second predefined fan speed.

The expression "not falling below" may in particular mean not falling below a certain level over a further specific time period. The further specified time period may be, for example, a time period in the order of seconds (for example in the range of 2-20 seconds).

The second predefined fan speed may be a fan speed at which safe ventilation is ensured in (normal) operation of the cooled laboratory equipment. Here, "safe" may refer, for example, to a temperature, for example a temperature in the interior, that should be maintained for safety reasons, or, for example, to an escape of refrigerant, for example in the event of a leak. Here, "safe" may mean, for example, that the escape of refrigerant may be safely compensated for at the fan speed by removal by means of ventilation. The second predefined fan speed may also be above a minimum fan speed (which may also be referred to as forced ventilation speed) at which safe ventilation is just ensured in (normal) operation of the cooled laboratory equipment.

The second predefined fan speed may itself be a variable value. For example, the second predefined fan speed may depend on a temperature, for example a temperature of the interior or an outside temperature.

The presented embodiment makes it possible to reliably assess the functionality of the second control device (and also of the fan) in a simple and easy-to-implement manner with little effort in terms of control and testing. In this way, damage to other devices of the cooled laboratory equipment may be prevented. A simulation of typical ventilation situations of the cooled laboratory equipment—as they occur during normal operation of the cooled laboratory equipment—may be carried out even before the actual start of normal operation.

In an advantageous embodiment of the method according to the invention, if the fan speed falls below the second predefined fan speed, the first control device briefly increases the speed of the fan.

The short-term speed increase may also be referred to as a "boost". The short-term speed increase may be implemented in particular if the second predefined fan speed is slightly undershot. In such cases, it may be assumed that, for example, there is a mechanical problem with the fan that may possibly be solved by a short boost. This could be, for example, dust deposits on the fan. The short-term speed increase may be within an interval of 0.5 to 5 seconds, preferably 1 to 2 seconds. The short-term speed increase may be implemented several times in succession if the speed falls below the second predefined fan speed several times in succession.

The short-term speed increase may also lead to a possible malfunction of the second control device causing a drop in the speed of the fan being remedied.

The presented embodiment makes it possible to remedy an underlying cause in a simple manner if the fan speed is too low. In particular, the cause may be of a mechanical nature or may originate in the second control device. In particular, the embodiment is user-friendly, since a possible deactivation of a main switch of the cooled laboratory equipment and/or a renewed switching off and on and/or even repairs of the cooled laboratory equipment may be avoided.

In an advantageous embodiment of the method according to the invention, the power supply for the at least one further device to be electrically powered is permanently or temporarily deactivated if a third predefined criterion is not observed.

The third predefined criterion may be, in particular, the absence of dropping below a third predefined fan speed. The third predefined fan speed may be a minimum fan speed (which may also be referred to as forced ventilation speed) at which safe ventilation is just ensured in (normal) operation of the cooled laboratory equipment. The third predefined fan speed may be lower than the second predefined fan speed (if provided).

The permanent deactivation may in particular be a deactivation of a switch, for example a relay, for the power supply of the at least one further device to be electrically powered. The switch or relay may concern a main power supply of the cooled laboratory equipment which is deactivated. The deactivation may be maintained, for example, until the cooled laboratory equipment is subsequently switched on again or for a predefined time period.

The presented embodiment increases operational safety because operation of the cooled laboratory equipment may be avoided in advance in the event of a malfunction of the second control device and/or the fan. In particular, the malfunction is detected before operation starts, and therefore damage to further devices of the cooled laboratory equipment or dangerous situations in which refrigerant is not removed or is not removed sufficiently are able to be avoided.

In an advantageous embodiment of the method according to the invention, the activation of the power supply for the at least one further device to be electrically powered takes place only after the expiry of a second time period which begins with or after the transfer of the fan control to the second control device.

The second time period may be understood, for example, as the minimum time period in which the checking with the aid of the second predefined criterion must take place in any case. This further increases the informative value and the quality of the information provided by the checking with the aid of the second predefined criterion and thus the operational safety of the cooled laboratory equipment.

In an advantageous embodiment of the method according to the invention, before ventilating the interior of the cooled laboratory equipment, it is checked whether the power supply for the at least one further device to be electrically powered is deactivated and/or whether a fan speed detection is functioning properly.

The aforementioned measures, in the course of ventilating the interior or in the course of the method according to the invention in general, prevent the at least one further device to be electrically powered from being supplied with electric current, for example due to a malfunction, and thus representing a source of danger due to possible sparking. For example, if the further device to be supplied with electric current may be supplied with current by means of a relay, it may be checked whether the relay is properly deactivated.

A proper function of the fan speed detection may, for example, be configured in such a way that it is checked whether the fan, which is still stationary, properly emits a signal that its speed is at zero before the interior is ventilated.

If a check whether the power supply is deactivated and/or whether a fan speed detection is functioning properly is unsuccessful, a performance of further steps of the method according to the invention, in particular ventilation, may be prevented. This further increases operational safety. In particular, correct fan speed detection further increases the probability that further method steps may be performed properly and correctly, in particular if the first predefined criterion and/or the second predefined criterion (and, if applicable, the third predefined criterion) each depend on fan speeds.

Further proposed is an item of laboratory equipment cooled by means of a flammable refrigerant and comprising a fan configured to ventilate an interior of the cooled item of laboratory equipment; first control device configured to control the fan in such a way that ventilation of the interior is carried out over a first time period; a checking device configured to check, using a first predefined criterion, whether ventilation was successful over the first time period; a second control device configured to control the fan; a transfer device configured to transfer control of the fan to the second control device if ventilation was successful over the first time period; an activation device configured to activate a power supply for at least one further device, which is to be electrically powered, of the cooled item of laboratory equipment if the fan is being successfully controlled by the second control device; wherein the checking device is additionally configured to check, with the aid of a second predefined criterion, whether the fan is successfully controlled by the second control device, or the cooled item of laboratory equipment comprises a further checking device configured to check, with the aid of a second predefined criterion, whether the fan is being successfully controlled by the second control device.

The cooled laboratory equipment may in particular be configured to carry out the method according to the invention in at least one of the embodiments described, in particular to carry out the method automatically. With regard to the cooled laboratory equipment and embodiments of the cooled laboratory equipment, full reference is made to explanations of the method according to the invention and to the embodiments of the method according to the invention. In particular (but not exclusively), reference is made here to explanations of the cooled laboratory equipment, the flammable refrigerant, the fan, the interior, the first control device, the first time period, the checking device, the first predefined criterion, the second predefined criterion, the ventilation, the second control device, the transfer device, the control of the fan and the transfer of the control, the activation device, the further device to be supplied with electric current and the further checking device.

In particular, the first control device, the checking device, the second control device, the transfer device, the activation device and/or the further transfer device may be units integrated into the cooled laboratory equipment. Said devices may each, at least partially or all, comprise at least one electronic component and/or a programmable computing device and/or may use or share a programmable computing device. Preferably, the first control device does not comprise a programmable computing device and/or is not or is only indirectly connected to a programmable computing unit.

In one embodiment, the cooled laboratory equipment may in particular be a laboratory freezer or a centrifuge.

In different exemplary embodiments, like reference signs are used for functionally like devices, steps, instances and elements. However, this does not necessarily mean that the exemplary embodiments are the same exemplary embodiment or parts of the same exemplary embodiment.

FIG. 1 shows a cooled item of laboratory equipment 1 according to the invention, which is embodied as a laboratory centrifuge. However, the invention is not limited to laboratory centrifuges. For example, the cooled item of laboratory equipment 1 could also be a laboratory freezer. The cooled laboratory equipment 1 has a fan 2. A speed sensor 22 and a fan motor 21 are provided on the fan 2, or more precisely on a fan shaft. The speed sensor 22 and the fan motor 21 may be understood as parts of the fan 2. The fan 2 is located at a first opening OE1 of a housing 11 of the cooled laboratory equipment 1. The housing 11 may have a cover, which may be opened, (not shown) to provide access to a centrifuge rotor 4. The centrifuge rotor 4 may be rotated by a drive motor 5 integrated in the housing. The centrifuge rotor 4 is further rotatably mounted via rotor bearings 52 which are integrated in the housing and which may for example be embodied as roller bearings. A second opening OE2 is provided on the side of the housing 11 opposite the first opening OE1 to allow ventilation through the interior 3. Further openings (not shown) may be provided.

The cooled laboratory equipment 1 has an interior 3. The interior 3 extends substantially below the centrifuge rotor 4, i.e. facing away from the upper side of the centrifuge rotor with sloping insertion regions for sample tubes, and extends as far as the underside of the cooled laboratory equipment 1. Inside the interior 3 there is a small amount of refrigerant KM in the shown state of the cooled laboratory equipment 1—for example due to a small leak at the refrigerant circuit KM and a long standing time of the cooled laboratory equipment without use. The refrigerant KM is a flammable refrigerant, for example propane.

The cooled laboratory equipment 1 has a refrigeration circuit KAE. The refrigeration circuit KAE has several evaporators 6 (i.e. cold generators). They serve in particular to cool the centrifuge rotor 4, the surroundings of the centrifuge rotor 4, the drive motor 5 and the rotor bearings 52. The refrigeration circuit KAE further comprises a compressor 7, a condenser 8 (which may be a liquefier) located outside the housing 11, and a throttle 9. The compressor 7 is connected to a power line 73 which is used to supply power to the compressor 7. The drive motor 5 is connected to a power line 53 which is used to supply power to the drive motor 5. The compressor 7 and the drive motor 5 may be understood in the light of the general description as further devices, which are to be electrically powered, of the cooled laboratory equipment 1.

The cooled laboratory equipment 1 is supplied with electric current via an external power supply EX (which may have a mains plug and possibly a mains adapter) and a mains cable EXN. The mains cable EXN docks onto an on/off switch 10 of the cooled laboratory equipment. The on/off switch 10 has a push button (indicated here) for switching on/off. The on/off switch 10, when turned on, allows electric current to flow through a power line 103, a power line ST13, a power line UEP3, and a power line ST23. The power lines through each of which electrical circuits may be established are explained in more detail below.

The power line ST13 runs from the on/off switch 10 to a first control device ST1. The power line ST23 runs from the on/off switch 10 to a second control device ST2. The power line 103 runs from the on/off switch 10 to an activation device AKE. The power line UEP3 runs from the on/off switch 10 to a checking device UEP.

The first control device ST1 is configured to allow ventilation of the interior 3 of the fan 2 over a first time period, which may last 8-10 seconds, for example. Here, a voltage may be applied to the fan 2 which causes the fan 2 to be operated at a maximum speed, for example at least at 2500 revolutions per minute.

The first control device ST1 is hardware-based. It has a switch that may establish a power supply to the fan 2 (more precisely: to the fan motor 21) coming from the power line ST13, which may ultimately supply both the fan 2 and the first control device ST1 itself with electric current. The switch may be basically switched on at the start of an operation of the cooled laboratory equipment 1 or may be configured to be automatically switched on, or to be automatically switched on for the first time period. With regard to the term "hardware-based", reference is also made to the explanations in the general part of the description.

In principle, it is not excluded within the scope of the present invention that the first control device ST1 alternatively or additionally has a control by a chip or processor and has control commands which may control the fan 2 (the fan motor 21) or a power supply of the fan 2 (the fan motor 21). It is not excluded that the first control device ST1 is configured to be able to set a speed of the fan 2 (the fan motor 21), for example, by means of pulse width modulation. In principle, however, it is preferred that the first control device ST1 is simple in design and achieves its functionality, for example, with the aid of the mentioned switch (which may be an on/off switch).

An interface ST1-UEG is used for the purpose of controlling and/or supplying power to the fan 2 (the fan motor 21). The interface ST1-UEG may be configured to transmit or route electrical energy (and/or alternatively or additionally control commands) from the first control device ST1 to a transfer device UEG. The interface ST1-UEG may thus have a power line, which may establish an electrical circuit, and possibly additionally also a data line. The transfer device UEG is configured to transfer the control of the fan 2 (the fan motor 21) from the first control device ST1 to the second control device ST2 or vice versa from the second control device ST2 to the first control device ST1. For this purpose, the transfer device UEG may have a switch which may in particular perform a change in the power supply of the fan motor 21 between the first control device ST1 and the second control device ST2. An interface UEG-2 leads from the transfer device to the fan 2 (to the fan motor 21) and comprises a power line (which may establish an electrical circuit) to allow a power supply to the fan motor 21. It is not excluded that the interface UEG-2 also has a data line if, for example, the fan 2 is configured accordingly (if, for example, it has its own further control device).

Furthermore, the checking device UEP is provided. It is configured to use a first predefined criterion to check whether the ventilation of the interior was successful over the first time period. The first predefined criterion may be that a first predefined fan speed (for example 2500 rpm) is reached and maintained for a minimum time period (corresponding to the first time period, which may be for example 8 seconds long) for safe ventilation. Other configurations of the first predefined criterion are not excluded.

In the presented embodiment of the cooled laboratory equipment 1 according to the invention, the checking device UEP is configured in such a way that it has a computing device (for example a processor) and corresponding commands. It is not excluded that the checking device UEP is configured differently, in particular more simply, for example as an electrical capacitor which is charged as soon as a specific fan speed is reached and which (at the earliest) after expiry of the first time period has reached a specific voltage value (threshold switch) which triggers a switch-over at the transfer device UEG.

Alternatively or additionally, it is also not excluded that the checking device UEP comprises a device for time counting, which starts a time measuring process as soon as the first predefined fan speed is reached and, as soon as the first time period has elapsed, triggers the switch-over at the transfer device UEG.

The checking device UEP is connected to the speed sensor 22 via an interface 22-UEP and may therefore receive a fan speed signal for the purpose of checking whether the first predefined criterion is met. The interface 22-UEP is configured to transmit the fan speed signal from the speed sensor 22 (which may be a Hall sensor, for example) so that it may be received and interpreted to check that ventilation of the interior has been successful over the first time period. Receiving and interpreting is done by the UEP checking device. All mentioned interfaces, including the interface 22-UEP, may have, for example, a power cable and/or a data cable.

Furthermore, the checking device UEP is connected to the first control device ST1 via an optional interface UEP-ST1. Within the scope of the checking of whether the ventilation was successful, the optional interface UEP-ST1 may be used by the checking device UEP to check, for example, whether the switch of the first control device ST1 was switched properly during the first time period.

Furthermore, the checking device UEP is connected to the transfer device UEG via an interface UEP-UEG. If the first predefined criterion has been fulfilled, i.e. the ventilation of the interior 3 has been successful, a signal is sent to the transfer device UEG via the interface UEP-UEG so that it may be switched over from the first control device ST1 (and from the interface ST1-UEG) to the second control device ST2 (and the interface ST2-UEG), i.e. for example the switch of the transfer device UEG may be switched over. The switch of the transfer device UEG may be configured to be switchable for this purpose using this signal.

The second control device ST2 is configured to allow control of the fan 2, for example by means of pulse width modulation (PWM). The second control device ST2 is firmware-based. In particular, this may mean that it comprises a memory, for example a ROM memory, which contains control commands, for example functional relationships or (predefined) characteristic curves which allow the fan 2 (the fan motor 21) to be controlled as required, for example based on temperature values which a temperature sensor (not shown) in the interior 3 and/or a temperature sensor outside the interior 3 may measure. It is not excluded that the second control device ST2 is alternatively or additionally software-based, for example comprises a read-write memory containing such control commands that may be adapted. The second control device ST2 further contains a computing device, for example a processor, for implementing and interpreting the control commands.

The second control device ST2 may be configured to control the fan 2 even during normal operation of the cooled laboratory equipment.

For the purpose of controlling and/or supplying power to the fan 2 (the fan motor 21), an interface ST2-UEG is used. The interface ST2-UEG may be configured to transmit or route electrical power and/or control commands from the second control device ST2 to the transfer device UEG. The interface ST2-UEG may have a power line, which may establish an electrical circuit, and if necessary additionally also a data line. The transfer device UEG is configured to transfer the control of the fan 2 (the fan motor 21) to the second control device ST2. When the transfer has taken place, the fan 2 (the fan motor 21) is supplied with electric current via the interface ST2-UEG and the further interface UEG-2.

In the presented embodiment of the cooled laboratory equipment 1, the checking device UEP is configured to use a second predefined criterion to check whether the fan 2 is successfully controlled by the second control device ST2. The second predefined criterion that must be fulfilled is that the fan speed must not fall below a predefined minimum speed for safe basic ventilation (second predefined fan speed) over a second time period. The second time period may be 5 seconds long, for example. The second predefined fan speed may be, for example, 1100 revolutions per minute.

The checking device UEP is connected to the speed sensor 22 via an interface 22-UEP and may therefore receive a fan speed signal for the purpose of checking whether the second predefined criterion is met. The checking device UEP may additionally include a timing device.

The interface 22-UEP is configured to transmit the fan speed signal from the speed sensor 22 so that it may be received and interpreted to check that control has been successful over the second time period. Receiving and interpreting is done by the UEP checking device.

Furthermore, the checking device UEP is connected to the second control device ST2 via an optional interface UEP-ST2. Within the scope of the checking of whether the control was successful over the second time period, the optional interface UEP-ST2 may be used by the checking device UEP to check additionally, for example, whether the fan 2 was controlled properly by the second control device ST2 during the second time period.

If control over the second time period is successful, i.e. the second predefined criterion is fulfilled, then a signal is sent via an interface UEP-AKE to the activation device AKE that power supplies for the compressor 7 (via the power line 73) and the drive motor 5 (via the power line 53) may be activated. The activation device 103 has in particular a switch, for example a relay, which may establish the power supplies in the presence of an appropriate signal.

The cooled laboratory equipment 1 is shown in a state in which refrigerant KM is in the interior 3. The control by the first control device ST1—the ventilation of the interior 3 over the first time period—already removes the refrigerant KM completely from the interior 3, so that it is no longer present and no longer poses a danger when activating potentially spark-forming devices, which are to be electrically powered, of the cooled laboratory equipment 1 (compressor 7 and drive motor 5). At the time of activation, the control of the fan 2 with the aid of the second control device ST2 is also checked for proper functioning. The second control device ST2 also controls the fan during normal operation of the cooled laboratory equipment 1, which may follow.

The checking device UEP may optionally additionally be configured to initiate a short-term speed increase by the first control device ST1 if the fan speed falls below the second predefined fan speed (minimum speed for safe basic ventilation in operation) within the second predefined time period. The checking device UEP may be configured (in particular, it may have corresponding control commands), in this case, to instruct the transfer device UEG to carry out a switch-over process to the first control device ST1. The short-term speed increase may take place, for example, over a short time period (for example of 1 second) until a switch back is made. The checking device UEP may be configured in such a way that the second time period is started anew after the short-term speed increase in order to check whether the control by the second control device ST2 is successful.

The checking device UEP may optionally additionally be configured to deactivate or block the switch (which may be for example a relay) of the activation device AKE, which is able to allow power supplies for the compressor 7 (via the power line 73) and the drive motor 5 (via the power line 53), for a specific time period or permanently (for example until the cooled laboratory equipment 1 is switched on again) if the fan speed falls below a third predefined (critical) speed which would no longer ensure safe operation in the event of a leak. The third predefined fan speed may be for example 500 revolutions per minute.

The checking device UEP may optionally additionally be configured to check a signal of the speed sensor 22 and/or the correct state of the activation device AKE even before the first time period, i.e. before the start of ventilation of the interior 3. For this purpose, the checking device UEP may have corresponding control commands. The signal of the speed sensor (which may also be called a tachometer signal) should correspond to a fan speed of zero at the start. The switch of the activation device AKE should be deactivated. The checking device UEP may be configured, if at least one of these criteria is not fulfilled, to deactivate or block the switch (which may be for example a relay) of the activation device AKE, which is able to allow power supplies for the compressor 7 (via the power line 73) and the drive motor 5 (via the power line 53), for a specific time period or permanently (for example until the cooled laboratory equipment 1 is switched on again).

Figure 2:
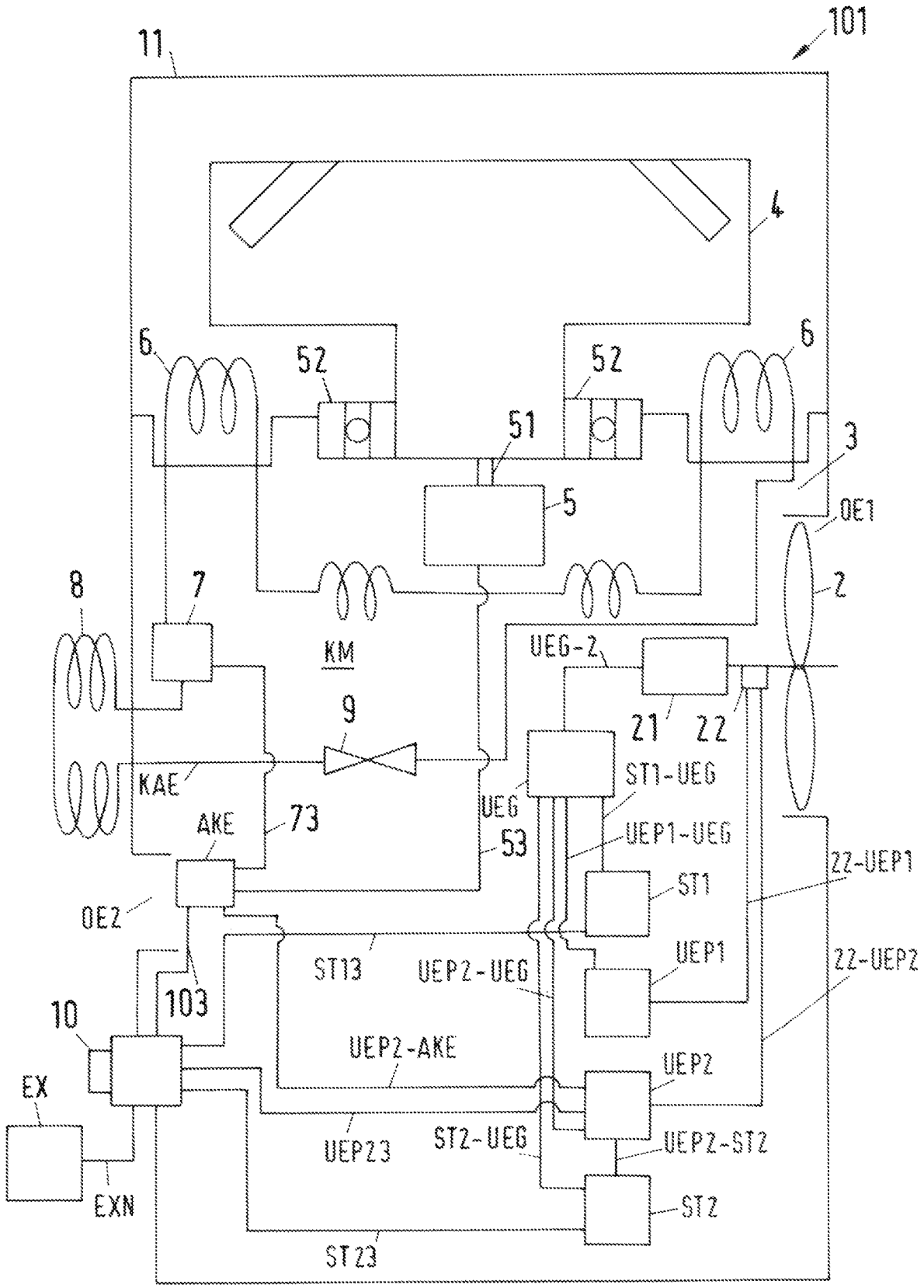
FIG. 2 shows a schematically illustrated further embodiment of a cooled item of laboratory equipment according to the invention.

FIG. 2 shows a further embodiment of the cooled laboratory equipment 101 according to the invention. However, in contrast to the cooled laboratory equipment 101, the cooled laboratory equipment 101 now shown has a first checking device UEP1 and a second checking device UEP2. The (common) checking device UEP is not present.

The comments regarding the first presented embodiment of the cooled laboratory equipment 1 apply accordingly, except for the following comments concerning the first checking device UPE1 and the second checking device UEP2 as well as the interfaces 22-UEP1, 22-UEP2, UEP2-ST2, UEP2-AKE and UEP2-UEG as well as the power line UEP23. The power line UEP23 runs from the on/off switch 10 to the second checking device UEP2.

The first checking device UEP1 is configured to check, with the aid of a first predefined criterion, whether the ventilation of the interior was successful over the first time period. The first predefined criterion is that a first predefined fan speed (for example 2500 rpm) is reached and maintained for a minimum time period (corresponding to the first time period, which may be for example 8 seconds long) for safe ventilation. In this way, any hazardous mixture that may be present may be neutralized within the cooled laboratory equipment. Other configurations of the first predefined criterion are not excluded.

The first checking device UEP1 has a threshold switch (for example an electrical capacitor that is charged as soon as the first predefined fan speed is reached). Alternatively or additionally, it may have a time counting device that starts a time measurement process as soon as the first predefined fan speed is reached.

The first checking device UEP1 is connected to the speed sensor 22 via an interface 22-UEP1 and may therefore receive a fan speed signal for the purpose of checking whether the first predefined criterion is fulfilled.

Via the interface UEP1-UEG, the information that the specified voltage value of the electrical capacitor has been reached or that the time measurement process has reached the minimum period is transmitted to the transfer device UEG. This information may mean that the ventilation of the cooled laboratory equipment was successful.

This triggers a switch-over at the transfer device UEG so that a switch-over may be made from the first control device ST1 (and from the interface ST1-UEG) to the second control device ST2 (and the interface ST2-UEG), i.e. the switch of the transfer device UEG may be switched over. The switch of the transfer device UEG is configured for this purpose to be suitable for switch-over on the basis of the information.

The interface 22-UEP1 is configured to transmit the fan speed signal from the speed sensor 22 (which may be configured as a Hall sensor, for example) so that the threshold switch (for example an electrical capacitor that is charged) or an alternative timer/counter of the first checking device UEP1 may be used to check whether the first predefined criterion is fulfilled.

In the presented embodiment of the cooled laboratory equipment 101, the second checking device UEP2 is configured to use a second predefined criterion to check whether the fan 2 is successfully controlled by the second control device ST2. The second predefined criterion that must be fulfilled is that the fan speed must not fall below a second predefined fan speed (this may be a pre-specified minimum speed for safe basic ventilation) over a second time period. The second time period may be 5 seconds long, for example. The second predefined fan speed may be, for example, 1100 revolutions per minute.

The second checking device UEP2 is connected to the speed sensor 22 via an interface 22-UEP2 and may therefore receive a fan speed signal for the purpose of checking whether the second predefined criterion is met.

The interface 22-UEP2 is configured to transmit the fan speed signal from the speed sensor 22 so that it may be received and interpreted to check that control has been successful over the second period. Receiving and interpreting is done by the second checking device UEP2.

Furthermore, the second checking device UEP2 is connected to the second control device ST2 via an optional interface UEP-ST2. Within the scope of the checking of whether the control was successful over the second time period, the optional interface UEP-ST2 may be used by the second checking device UEP2 to check, for example, whether the fan 2 was controlled properly by the second control device ST2. It is not excluded that the second checking device UEP and the second control device ST2 are configured as a common unit.

If control over the second time period is successful, i.e. the second predefined criterion is fulfilled, then a signal is sent via an interface UEP2-AKE to the activation device AKE that power supplies for the compressor 7 (via the power line 73) and the drive motor 5 (via the power line 53) may be activated. The activation device 103 has in particular a switch, for example a relay, which may establish the power supplies in the presence of an appropriate signal.

The second checking device UEP2 may exchange information with the transfer device UEG via the interface UEP2-UEG. For example, the second checking device UEP2 may optionally additionally be configured to initiate a short-term speed increase by the first control device ST1 if the fan speed falls below the second predefined fan speed (pre-specified minimum speed for safe basic ventilation in operation). The second checking device UEP2 may be configured (in particular, it may have corresponding control commands) to instruct the transfer device UEG in this case to carry out a switch-over process to the first control device ST1. The short-term speed increase may take place for a short time (for example over a period of 1 second) until it is switched back (short boost of the fan 2 to avoid a critical lower speed). The second checking device UEP2 may be configured in such a way that the second time period is started anew after the short-term speed increase in order to check whether the control by the second control device ST2 is successful.

The second checking device UEP2 may optionally additionally be configured to deactivate or block the switch (which may be for example a relay) of the activation device AKE, which is able to allow power supplies for the compressor 7 (via the power line 73) and the drive motor 5 (via the power line 53), for a specific time period or permanently (for example until the cooled laboratory equipment 101 is switched on again) if the fan speed falls below a third predefined speed which would no longer ensure safe operation in the event of a leak. The third predefined fan speed may be for example 500 revolutions per minute.

The second checking device UEP2 may optionally additionally be configured to check a signal of the speed sensor 22 and/or the correct state of the activation device AKE even before the first time period, i.e. before the start of ventilation of the interior 3. For this purpose, the second checking device UEP2 may have corresponding control commands. The signal of the speed sensor (which may also be called a tachometer signal) should correspond to a fan speed of zero at the start; the switch of the activation device AKE should be deactivated.

The second checking device UEP2 may be configured, if at least one of these criteria is not fulfilled, to deactivate or block the switch (which may be for example a relay) of the activation device AKE, which is able to allow power supplies for the compressor 7 (via the power line 73) and the drive motor 5 (via the power line 53), for a specific time period or permanently (for example until the cooled laboratory equipment 101 is switched on again).

Figure 3:
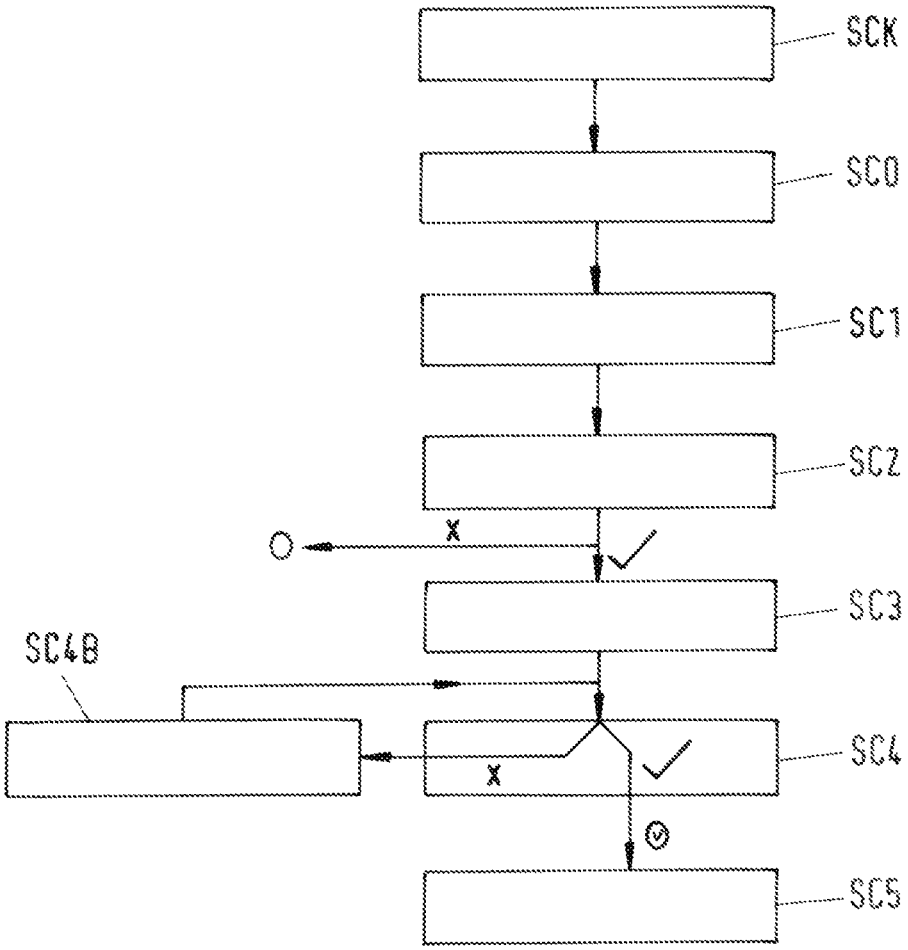
FIG. 3 shows a schematically illustrated embodiment of the method according to the invention.

FIG. 3 shows an embodiment of the method according to the invention for operating an item of laboratory equipment (for example a laboratory centrifuge or a laboratory freezer) cooled by means of a flammable refrigerant. The cooled laboratory equipment may be, for example, the cooled laboratory equipment 1 or the cooled laboratory equipment 101. Full reference is made to the above explanations of embodiments of the cooled laboratory equipment according to the invention, where applicable, with reference being made to the comments in that regard. The cooled laboratory equipment 1 and the cooled laboratory equipment 101 may each be configured to carry out the method according to the invention, in particular to carry it out automatically.

In an optional upstream control step SCK, it is checked whether a power supply for further devices to be electrically powered is properly deactivated. The further devices to be electrically powered may be, for example, a drive motor 5 and/or a compressor 7 or a display or an electric opening mechanism of a lid of the cooled laboratory equipment.

In addition, it is possible to check within the control step SCK whether a fan speed detection is functioning properly, for example by checking whether a fan speed signal is zero at the start.

In a preliminary step SC0, it is checked whether the fan reaches a predefined minimum speed for safe ventilation or whether this predefined minimum speed is exceeded. If this is not the case, the cooled laboratory equipment may be stopped and automatically switched off.

After carrying out the preliminary step, in a first step SC1 an interior (for example the interior 3) of the cooled laboratory equipment is ventilated over a first time period. The fan is controlled here via a first control device (for example the first control device ST1), which may be hardware-based in particular. The first time period is selected in such a way that at a first predefined fan speed the interior of the cooled laboratory equipment is completely or almost completely freed of any refrigerant that may be present.

After ventilation has been carried out, in a second step SC2 it is checked whether a first predefined criterion (for example reaching a fan speed of at least 2500 rpm for 8 seconds, this fan speed may be referred to as the first predefined speed) has been fulfilled, for example with the aid of a simply constructed checking device, for example the first checking device UEP1. As mentioned, successful ventilation may alternatively or additionally be carried out with the aid of a more complex checking device, for example the checking device UEP.

Any refrigerant that may be present in the interior is now completely or almost completely removed, so that further devices, which are to be electrically powered, of the laboratory equipment do not pose any danger due to sparking, moreover before they are supplied with electric current.

In a third step SC3, if the control of the fan was successful (indicated by a tick), the control of the fan is transferred to a second control device, for example with the aid of the transfer device UEG. The second control device may in particular be a software- or firmware-based control device and may have stored control commands and/or characteristic curves.

If controlling the fan was not successful (indicated by an "x"), the process may be terminated. In particular, the cooled laboratory equipment may be switched off automatically, as indicated by the symbol "O".

In a fourth step SC4, a second predefined criterion (for example the fan must not fall below a predefined minimum speed for continuous safe ventilation, this speed may be referred to as the second predefined fan speed) is used to check whether the control of the fan is successful.

If this is not the case, but a third predefined criterion is not violated (for example drop of the fan speed below a predefined critical speed, which may be referred to as the third predefined fan speed, wherein this speed no longer ensures safe operation in the presence of a leak), a brief transfer of control to the first control device may take place in an optional additional step SC4B, which causes a brief fan speed increase (boost), in the direction of maximum fan speed. After this, the fourth step SC4 may be carried out again. The optional additional step SC4*b* may be executed a limited number of times. If the second predefined criterion is still not met, the process may be aborted, for example the cooled laboratory equipment may be switched off (not shown).

Checking whether the fan control is successful may be done with the help of a checking device (for example checking device UPE or second checking device UEP2).

If the ventilation is successful (indicated by a tick), the further devices to be electrically powered are activated in a fifth step SC5, for example with the help of an activation device, if necessary also with a time delay (indicated by a clock symbol)—this means that normal operation of the cooled laboratory equipment may start.

Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present disclosure.

What is claimed is:

1. A method for operating an item of cooled laboratory equipment cooled by means of a flammable refrigerant, the method comprising:

ventilating an interior of the item of the cooled laboratory equipment with the aid of a fan, wherein a control of the fan is carried out over a first time period by a first control device, wherein the ventilating of the interior is performed before activation a power supply for at least one further device, which is to be electrically powered, of the item of the cooled laboratory equipment;

checking, with the aid of a first predefined criterion, whether the ventilation was successful;

in response to determining, with the aid of the first predefined criterion, that the ventilation was successful, transferring the control of the fan to a second control device;

checking, with the aid of a second predefined criterion, whether the fan is being successfully controlled by the second control device;

in response to determining, with the aid of the second predefined criterion, that the fan is being successfully controlled by the second control device, activating the power supply for the at least one further device to be electrically powered;

characterized in that a power supply for the fan is established by a switch-on process of the item of the cooled laboratory equipment.

2. The method according to claim 1, characterized in that the first control device is a hardware-based control device.

3. The method according to claim 1, characterized in that the second control device is a software-based or a firmware-based control device.

4. The method according to claim 1, characterized in that the first criterion is or comprises not falling below or reaching a first predefined fan speed.

5. The method according to claim 1, characterized in that the second criterion is or comprises not falling below or reaching a second predefined fan speed.

6. The method according to claim 5, characterized in that, when a speed of the fan falls below the second predefined fan speed, the speed of the fan is increased by the first control device.

7. The method according to claim 1, characterized in that the power supply for the at least one further device to be electrically powered is permanently or temporarily deactivated when a third predefined criterion is not observed.

8. The method of claim 1, characterized in that the activation of the power supply for the at least one further device to be electrically powered takes place only after the expiry of a second time period which begins with or after the transfer of the fan control to the second control device.

9. The method according to claim 1, characterized in that, before ventilating the interior of the item of the cooled laboratory equipment, the method includes checking whether the power supply for the at least one further device to be electrically powered is deactivated or whether a fan speed detection is functioning properly or whether the power supply for the at least one further device to be electrically powered is deactivated and the fan speed detection is functioning properly.

10. An item of cooled laboratory equipment cooled by means of a flammable refrigerant and comprising:

a fan configured to ventilate an interior of the item of the cooled laboratory equipment, wherein a power supply for the fan is established by a switch-on process of the item of the cooled laboratory equipment;

a first control device configured to control the fan in such a way that ventilation of the interior is carried out over a first time period;

a checking device configured to check, using a first predefined criterion, whether the ventilation was successful over the first time period;

a second control device configured to control the fan;

a transfer device configured to transfer a control of the fan to the second control device when the ventilation was successful over the first time period;

an activation device configured to activate a power supply for at least one further device, which is to be electrically powered, of the item of the cooled laboratory equipment in response to a determination that the fan is, with the aid of a second predefined criterion, being successfully controlled by the second control device;

wherein:

the checking device is additionally configured to check, with the aid of the second predefined criterion, whether the fan is being successfully controlled by the second control device, or the item of the cooled laboratory equipment comprises a further checking device configured to check, with the aid of the second predefined criterion, whether the fan is being successfully controlled by the second control device.

11. The laboratory equipment according to claim 10, characterized in that the item of the cooled laboratory equipment is a laboratory freezer or a centrifuge.

* * * * *